US006045192A

United States Patent [19]

Faulise

[11] Patent Number: 6,045,192

[45] Date of Patent: Apr. 4, 2000

[54] APPARATUS FOR SUPPORTING AND ELEVATING THE LEGS AND FEET

[76] Inventor: Salvatore V. Faulise, 80 Bittersweet Hill, Wethersfield, Conn. 06109

[21] Appl. No.: 09/244,160

[22] Filed: Feb. 4, 1999

[51] Int. Cl.[7] ..... A47C 16/02

[52] U.S. Cl. ..... 297/423.39; 297/423.1; 403/84

[58] Field of Search ..... 297/423.39, 423.1; 403/84, 99; 248/188.9; 108/97, 106; 312/282

[56] References Cited

U.S. PATENT DOCUMENTS

| | | | |
|---|---|---|---|
| 195,425 | 9/1877 | Weddle | 297/423.39 |
| 217,621 | 7/1879 | Jungmann | 297/423.39 |
| 277,880 | 5/1883 | Burris et al. | 297/423.39 |
| 1,109,452 | 9/1914 | Morrison | 248/188.9 |
| 1,315,264 | 9/1919 | Walker . | |
| 1,738,810 | 12/1929 | White . | |
| 2,268,732 | 1/1942 | Walter et al. | 297/423.39 |
| 2,614,613 | 10/1952 | Bushong | 155/169 |
| 2,735,480 | 2/1956 | Mead | 155/182 |
| 3,264,033 | 8/1966 | Hansburg | 297/438 |
| 3,565,485 | 2/1971 | Eisenhauer | 297/433 |
| 3,695,684 | 10/1972 | Barberg | 297/438 |
| 4,067,614 | 1/1978 | Confer | 297/438 |
| 5,154,484 | 10/1992 | Aronson | 297/438 |

*Primary Examiner*—Anthony D. Barfield
*Attorney, Agent, or Firm*—Raymond A. Nuzzo

[57] ABSTRACT

An apparatus for supporting and elevating the legs and feet comprising a foot base having a feet receiving surface, and a leg extension movably attached to the foot base. The foot base has a leg receiving surface. The leg extension is movable to an opened position wherein the leg extension surface is angulated with respect to the feet receiving surface and to a closed position wherein the leg receiving surface confronts the feet receiving surface.

18 Claims, 8 Drawing Sheets

APPARATUS FOR SUPPORTING AND ELEVATING THE LEGS AND FEET

BACKGROUND OF THE INVENTION

1. Field of the Invention

The present invention generally relates to an apparatus for supporting and elevating the legs and feet.

2. Problem to be Solved

People periodically have need to rest or elevate their legs and/or feet. The reasons for this can be due to injury, aches, muscle strain or just relaxation. Typically, most people use a piece a furniture such as a coffee table, desk, hassock, etc. to rest their legs and/or feet. However, such a practice is inconvenient. Specifically, the user has to adjust his or her height with respect to the piece of furniture to ensure comfort when resting his or her feet on the particular piece of furniture. Furthermore, such a practice may result in the person's body being oriented in an awkward position that produces muscle strain and possibly injury.

Therefore, it is an object of the present invention to provide a novel apparatus for supporting and elevating the legs and feet that eliminates the problems discussed above.

It is another object of the present invention to provide a novel apparatus for supporting and elevating the legs and feet that is easy to use.

It is a further object of the present invention to provide a novel apparatus for supporting and elevating the legs and feet that can be manufactured at reasonable costs.

Other objects and advantages of the present invention will be apparent to one of ordinary skill in the art in light of the ensuing description of the present invention.

SUMMARY OF THE INVENTION

The present invention is directed to an apparatus for supporting and elevating the legs and feet comprising a foot base having a feet receiving surface, and a leg extension movably attached to the foot base. The foot base has a leg receiving surface. The leg extension is movable to an opened position wherein the leg extension surface is angulated with respect to the feet receiving surface and to a closed position wherein the leg receiving surface confronts the feet receiving surface.

BRIEF DESCRIPTION OF THE DRAWINGS

The features of the invention are believed to be novel and the elements characteristic of the invention are set forth with particularity in the appended claims. The invention itself may best be understood by reference to the detailed description which follows taken in conjunction with the accompanying drawings in which:

DESCRIPTION OF THE PREFERRED EMBODIMENTS

In describing the preferred embodiments of the present invention, reference will be made herein to FIGS. 1–9 of the drawings in which like numerals refer to like features of the invention.

Figure 2:
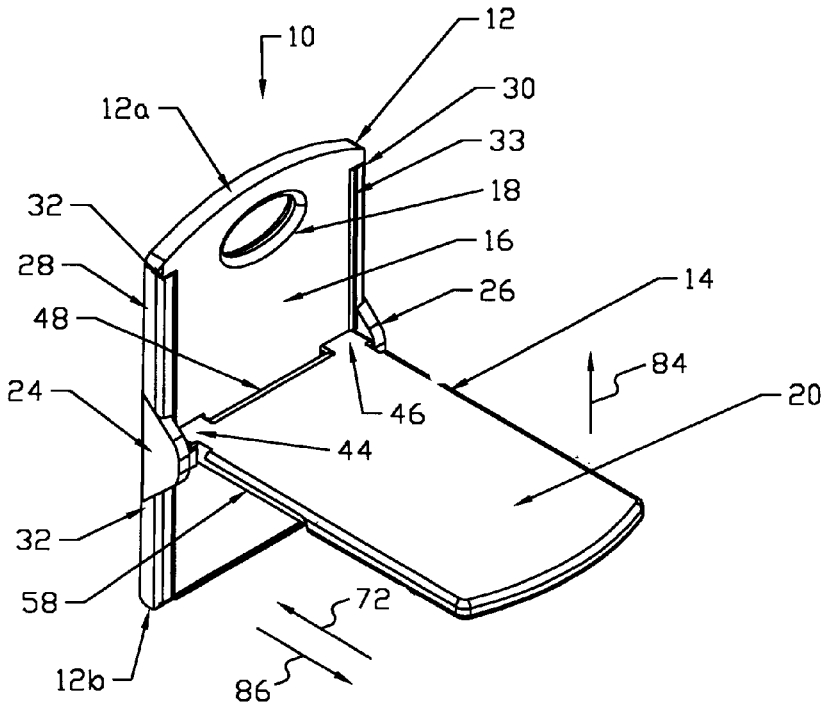
FIG. 2 is a perspective view of the apparatus of the present invention.

Referring to FIG. 2, there is shown apparatus 10 of the present invention. Apparatus 10 of the present invention generally comprises foot base 12 and leg extension 14. Leg extension 14 is movably attached to foot base 12. This feature will be described below in detail. Foot base 12 has a substantially planar surface 16 for receiving the feet of a user. Foot base 12 includes opening 18 that functions as a handle. Foot base 12 further includes top end 12*a* and bottom end 12*b*. Leg extension 14 has substantially planar surface 20 for receiving the legs of a user.

Figure 4:
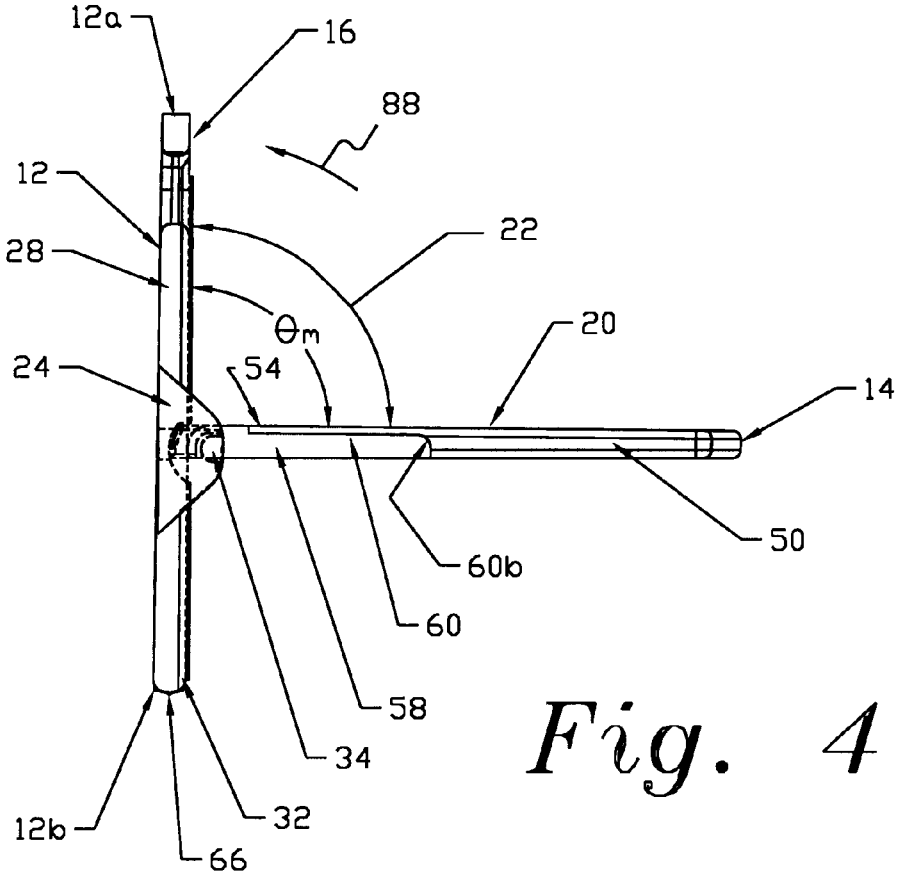
FIG. 4 is a side elevational view of the apparatus of the present invention wherein the leg extension is oriented in an opened position.
Figure 5:
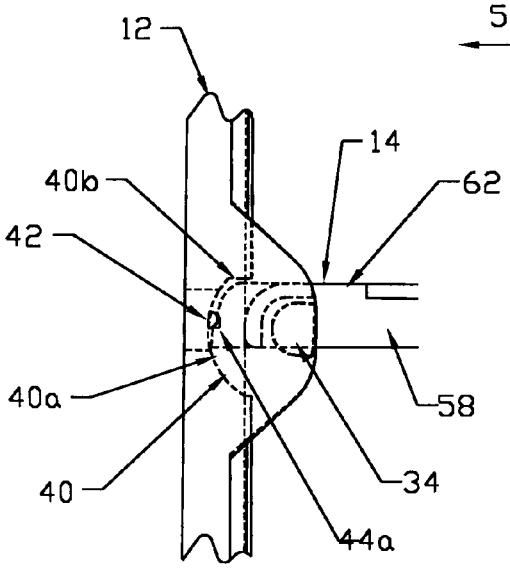
FIG. 5 is an enlarged view of a portion of FIG. 4 illustrating the engagement of a pivot block and the leg extension, both of which being depicted in FIGS. 1–4.
Figure 5A:
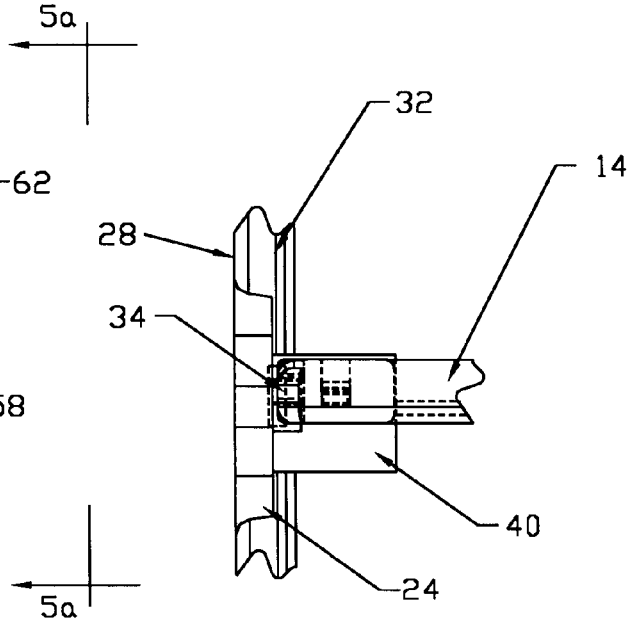
FIG. 5A is a view taken along line 5A—5A of FIG. 5A.
Figure 6:
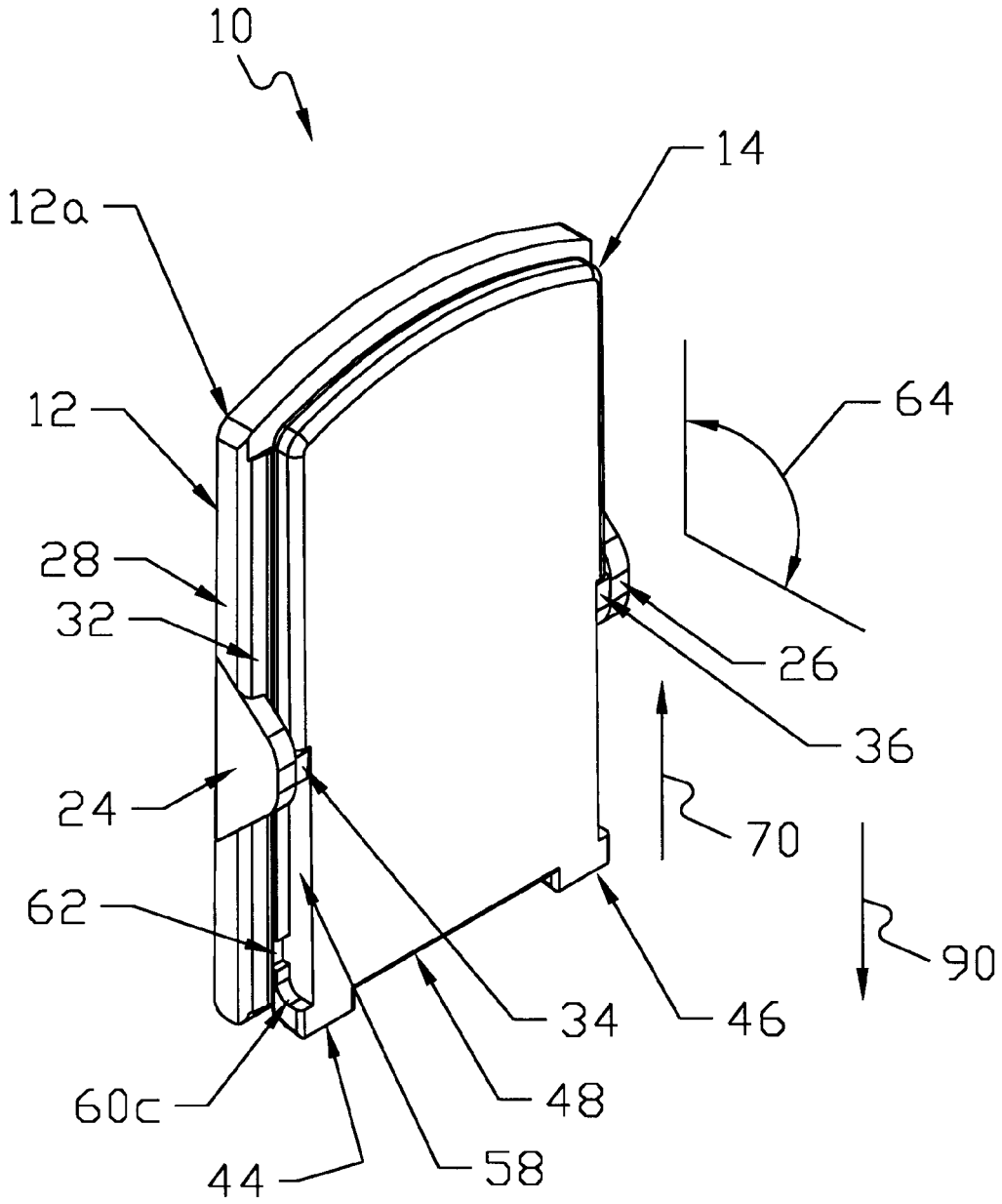
FIG. 6 is a perspective view of the apparatus of the present invention in a closed position.
Figure 8:
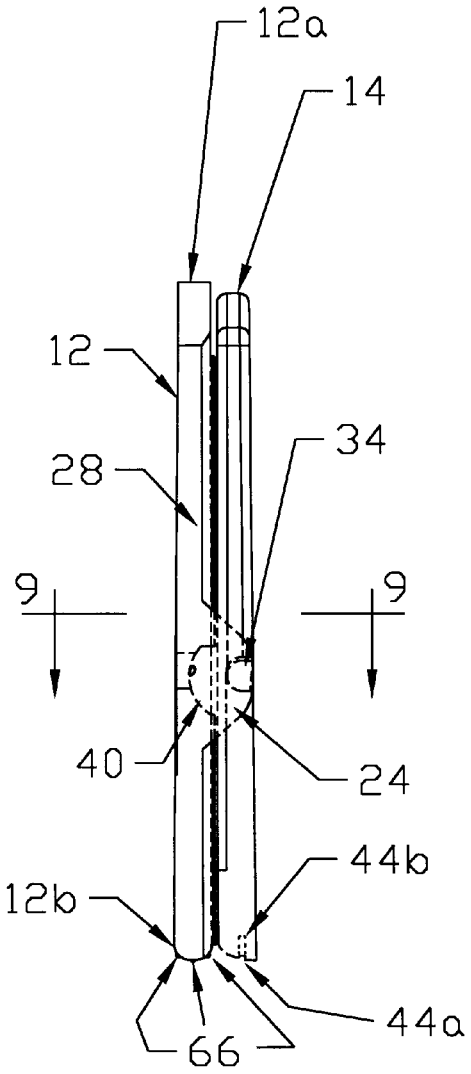
FIG. 8 is a side elevational view of the apparatus of the present invention in the closed position.
Figure 7:
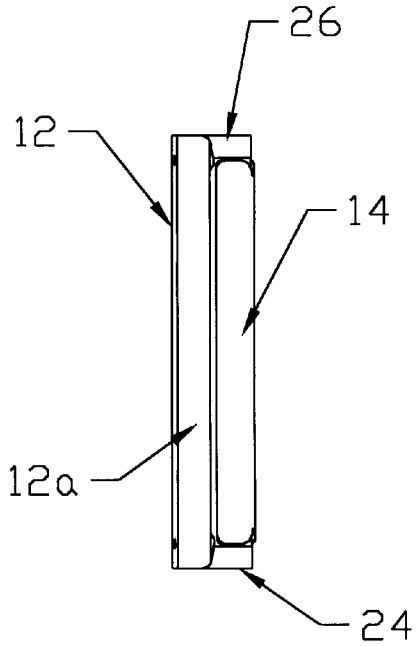
FIG. 7 is a top view of the apparatus of the present invention in a closed position.
Figure 9:
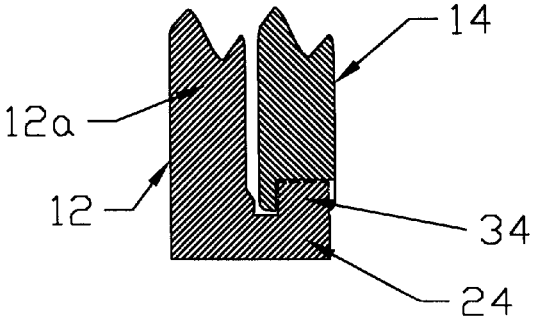
FIG. 9 is a view taken along line 9—9 of FIG. 8.

Referring to FIGS. 2, 4 and 6, leg extension 14 can move in the direction indicated by arrow 22 so as to enable leg extension 14 to be positioned in an opened position (see FIG. 4) or a closed position (see FIG. 6). The maximum angle to which leg extension 14 can move is indicated by $\theta_M$. In a preferred $\theta_M$ is about 90°. Thus, when leg extension 14 is in the opened position, it is substantially perpendicular to foot base 12.

Referring to FIGS. 2, 3, 3A and 3B, foot base 12 includes cantilever sidewalls 24 and 26. Foot base 12 has longitudinally extending axis 12*c*. Foot base 12 includes lengthwise edges 28 and 30. Foot base 12 further includes longitudinally extending guides 32 and 33 that are adjacent lengthwise edges 28 and 30, respectively. In one embodiment, guides 32 and 33 comprise ribs that extend upward from surface 16 of foot base 12. The purpose of guides 32 and 33 will be discussed below in detail.

Figure 3:
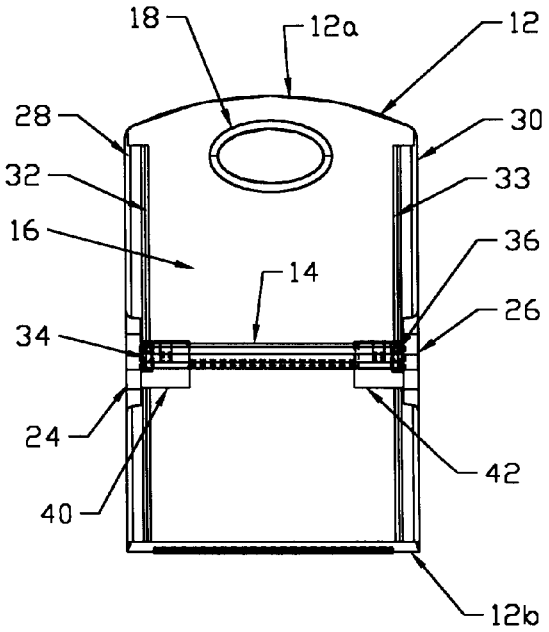
FIG. 3 is a front elevational view of the apparatus of the present invention.
Figure 3A:
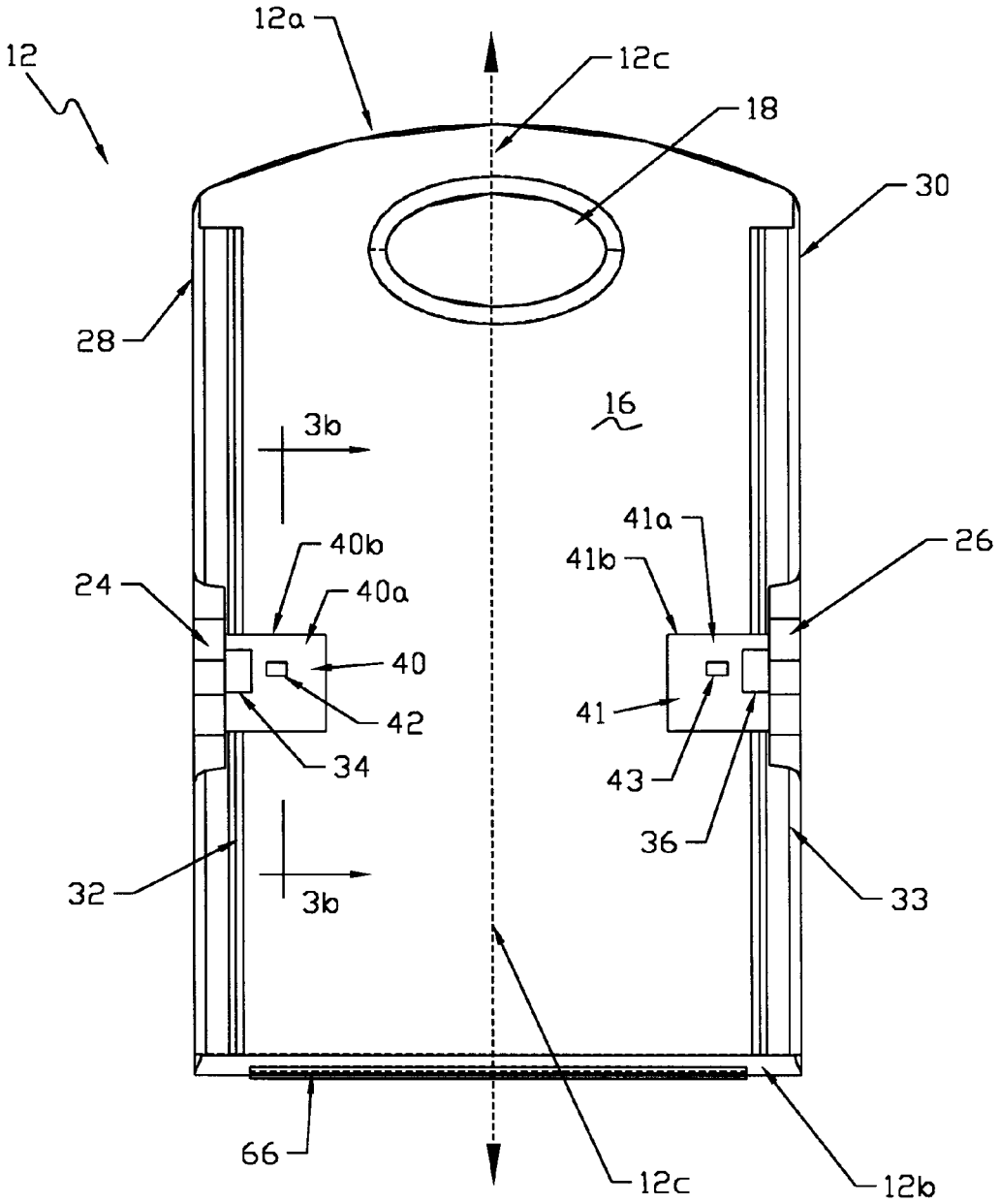
FIG. 3A is a front elevational view of a foot base shown in FIG. 2.
Figure 3B:
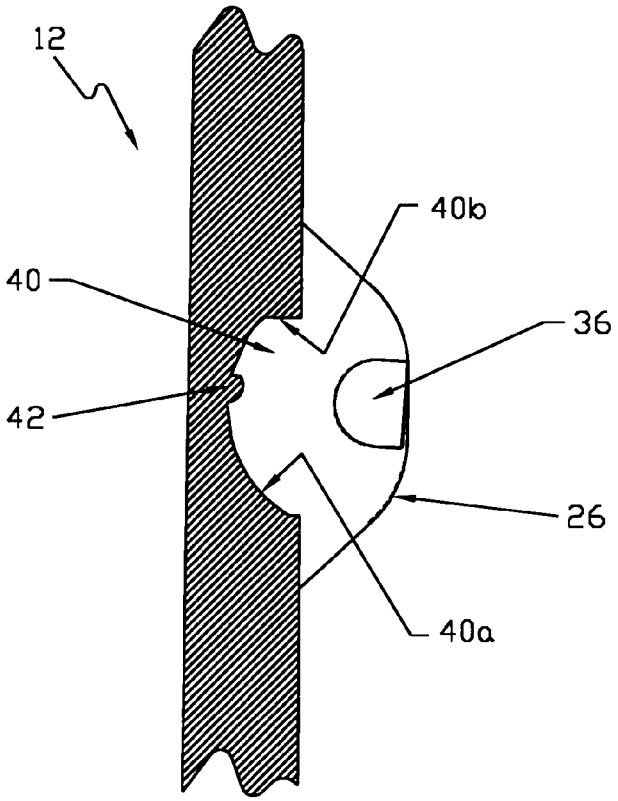
FIG. 3B is a side view taken along line 3B—3B of FIG. 3A.

Referring to FIGS. 3A and 3B, cantilever sidewalls 24 and 26 include pivot blocks 34 and 36, respectively. Foot base 12 further includes recessed areas 40 and 41 in surface 16 that are adjacent cantilever sidewalls 24 and 26, respectively. Recessed areas 40 and 41 are located behind pivot blocks 34 and 36, respectively. Recesses 40 and 41 have recess walls 40*a* and 41*a*, respectively. Each recess wall 40*a* and 41*a* includes substantially straight portion 40*b* and 41*b*, respectively. In a preferred embodiment, straight portions 40*b* and 41*b* are substantially perpendicular to longitudinal axis 12*c* of foot base 12. Each recess wall 40*a* and 41*a* further includes protrusions 42 and 43, respectively. The purpose of protrusions 42 and 43 is discussed below in detail.

Figure 3C:
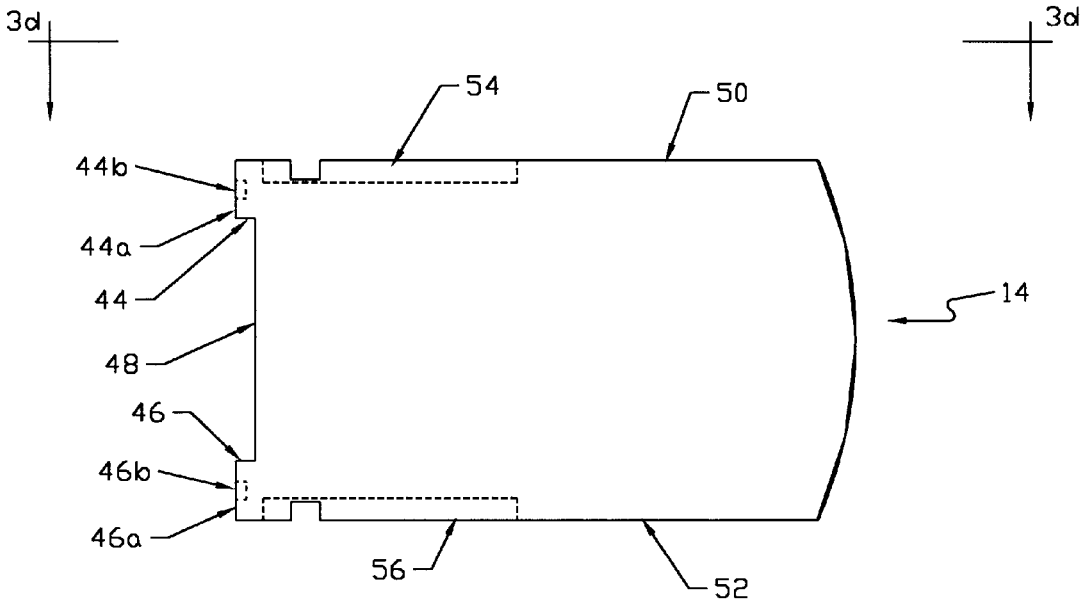
FIG. 3C is a top plan view of a leg extension shown in FIG. 2.

Referring to FIG. 3C, leg extension 14 further includes extending portions 44 and 46. Portions 44 and 46 are sized for positioning within recessed areas 40 and 41, respectively, of foot base 12. Portions 44 and 46 extend to distal ends 44*a* and 46*a*, respectively. In a preferred embodiment, distal ends 44*a* and 46*a* are rounded so as to match the curvature of recess walls 40*a* and 41*a*, respectively. Portions 44 and 46 define notches or cavities 44*b* and 46*b*, respectively. Notches 44*a* and 46*a* are sized for receiving protrusions 42 and 43, respectively. Relief area 48 is located intermediate portions 44 and 46 and provides clearance so as to enable leg extension 14 to freely pivot about pivot blocks 34 and 36 without interfering with surface 16 of foot base 12. This is explained below in detail. Leg extension 14 includes lengthwise ends 50 and 52 (see FIG. 3C). Leg extension 14 further includes portions 54 and 56 that are contiguous with lengthwise ends 50 and 52, respectively. When apparatus 10 is in a closed position, portions 54 and 56 are positioned behind pivot blocks 34 and 36, respectively, of foot base 12.

Figure 3D:
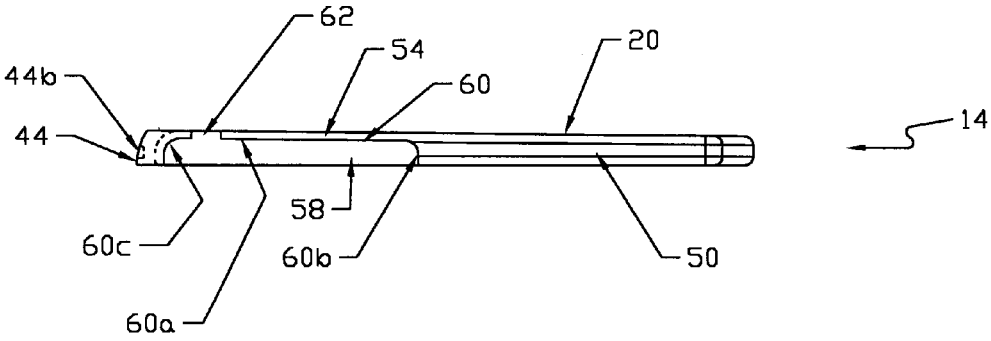
FIG. 3D is a side view taken along line 3D—3D of FIG. 3C.

Although the ensuing description is in terms of one lengthwise end of leg extension 14 (i.e. lengthwise end 50), it is to be understood that this description is also applicable to the lengthwise end 52. Referring to FIGS. 3C and 3D, leg extension 14 further includes recessed area 58 that is sized for receiving pivot block 34 of cantilever sidewall 24. Recessed area 58 is bordered by wall 60. Wall 60 has wall sections 60*a*, 60*b*, 60*c* and notch 62. Portion 54 of lengthwise end 50 is contiguous with wall section 60*a*. In a preferred embodiment, wall section 60*c* is rounded in order to facilitate a smooth contact with pivot block 34 (and similarly, pivot block 36) when leg extension 14 is pivoted as indicated by directional arrow 64 (see FIG. 6).

Referring to FIGS. 2 and 6, recessed area 58 allows a user to configure apparatus 10 from the closed position to the open position. Specifically, recess 58 allows leg extension 14 to be moved upward, with respect to foot base 12, in the direction indicated by arrow 70. This is explained below in detail.

Figure 1:
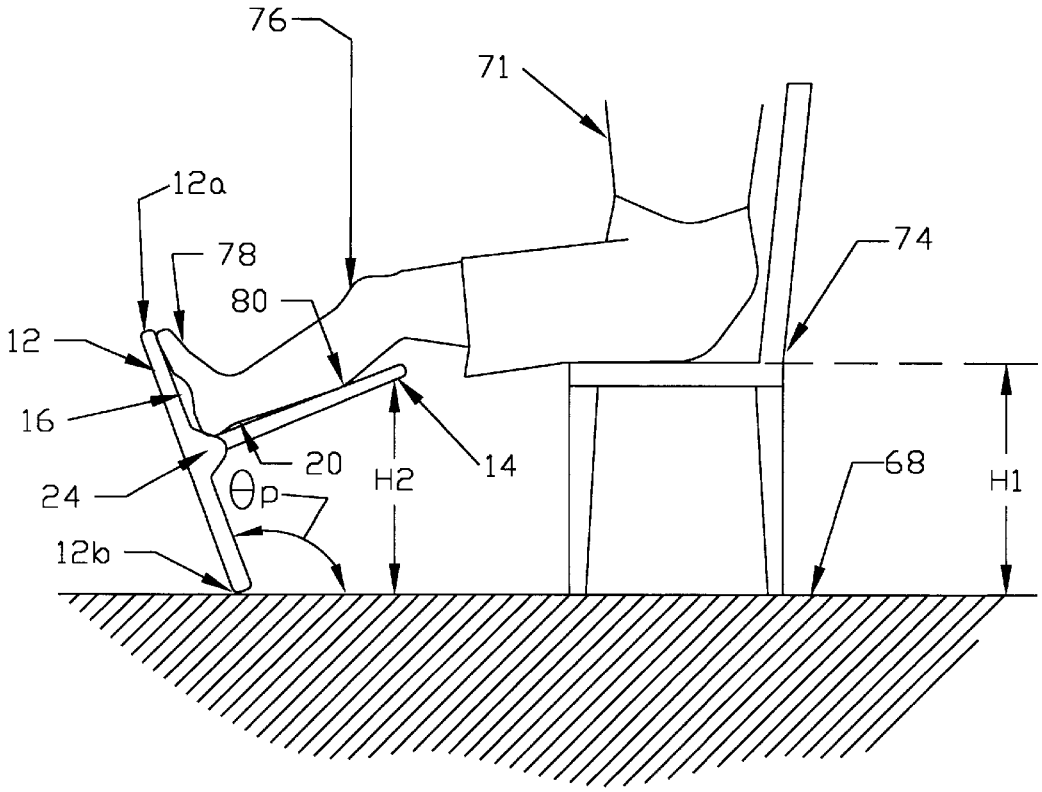
FIG. 1 is a side elevational view illustrating the apparatus of the present invention supporting and elevating the legs and feet of a user.

Referring to FIGS. 1, 3A and 4, foot base 12 further includes protrusions 66 extending from foot base bottom end 12*b*. In a one embodiment, protrusions 66 comprises at least one rib that extends for substantially the entire width of foot base 12. In one embodiment, there are a plurality of ribs. In a preferred embodiment, there are at least three ribs. Referring to FIG. 1, protrusions 66 provide frictional contact between foot base bottom end 12*b* and floor 68 thereby preventing foot base 12, and thus, apparatus 10 from sliding or moving when used as shown.

Operation

The ensuing description pertains to the operation and functioning of apparatus 10 and the interrelation and cooperation of all the components; and features discussed above. When user 71 (see FIG. 1) desires to use apparatus 10, he or she must configure apparatus 10 from the closed position (see FIG. 6), to the open position (see FIGS. 1 and 2). In order to accomplish this, the user grasps foot base 12 so as to maintain it stationary. The user then slides leg extension 14, upward with respect to foot base 12, as indicated by arrow 70. Leg extension 14 is moved upward until pivot block 34 contacts rounded wall section 60*c* and pivot block 36 contacts the other rounded wall section (not shown). This is referred to as the "intermediate" position. Once the leg extension is in the intermediate position, the user then pulls leg extension 14 away from foot base 12 so that leg extension 14 pivots about pivot blocks 34 and 36. Once leg extension 14 is pivoted so that it is substantially perpendicular to foot base 12 (see FIG. 2), the user then moves leg extension 14 axially as indicated by arrow 72 until pivot block 34 is disposed within notch 62 and pivot block 36 is disposed within the corresponding notch, located on lengthwise end 52. When this occurs, extending portions 44 and 46 are disposed within recesses 40 and 41, respectively, and protrusions 42 and 43 are disposed within notches 44*b* and 46*b*, respectively. Leg extension 14 is now in the opened position. The positioning of extending portions 44 and 46 within recesses 40 and 41, respectively, and protrusions 42 and 43 within notches 44*b* and 46*b*, respectively, prevent leg extension 14 from pivoting about pivot blocks 34 and 36 to angles greater than $\theta_M$.

Next, the user positions himself or herself on a chair 74 or other structure suitable for sitting and then positions apparatus 10 relative to the chair as shown in FIG. 1. The height above floor 68 at which user 71 sits is indicated as height H1 (see FIG. 1). The height above floor 68 at which leg extension 14 is positioned is indicated by height H2. In a preferred embodiment, the difference between height H1 and height H2 is such as to ensure comfort and to prevent undesirable strain and stress on the user's leg, hip and back muscles. User 71 positions his or her legs 76 and feet 78 in such a manner that legs 76 are positioned upon surface 20 of leg extension 14 and the bottom of feet 78 are placed against surface 16 of foot base 12. Preferably, user 71 positions his or her legs 76 such that rear portion 80 of legs 76 contact surface 20. In order to accomplish this, user 71 uses his or her own legs 76 to tilt or pitch foot base 12 away in a direction away from user 71. The degree of the pitch of foot base 12 is indicated by angle $\theta_p$. The range of the pitch angle $\theta_p$ is significantly increased by protrusions 66 (see FIG. 8) that prevent bottom foot base bottom end 12*b* from sliding along floor 68. Thus, protrusions 66 facilitate balancing apparatus 10 to various pitch angles $\theta_p$. Referring to FIG. 1, in a preferred embodiment, the pitch angle $\theta_p$ is between about 60° and 70°, inclusive.

The combination of the weight of the user's leg 76 and leg extension 14 (i) facilitates firm physical contact between leg extension 14 and straight wall section 40*b* of recess 40 (and the straight wall section of recess 41), and (ii) maintains protrusions 42 and 43 within notches or cavities 44*b* and 46*b*, respectively.

When the user 71 decides to configure apparatus 10 in the closed position (shown in FIG. 6), user 71 moves leg extension 14 upward, with respect to foot base 12, as indicated by arrow 84 (see FIG. 2), so as to remove (i) pivot block 34 from notch 62 and pivot block 36 from its corresponding notch, and (ii) protrusions 42 and 43 from notches 44*b* and 46*b*, respectively. Next, user 71 then maneuvers leg extension 14 so that pivot blocks 34 and 36 contact the rounded wall sections (i.e. rounded wall section 60*c* for pivot block 34) and then pivots leg extension 14 upward as indicated by arrow 88 in FIG. 4. When surface 20 of leg extension 14 approaches or confronts surface 16 of foot base 12, i.e. the intermediate position, user 71 maneuvers leg extension 14 in a manner such that as user 71 lowers leg extension 14 in the direction indicated by arrow 90 (see FIGS. 3C, 3D and 6), longitudinal ends 50 and 52 of leg extension 14 are positioned or nested between longitudinally extending guides 32 and 33, respectively, and portions 54 and 56 of leg extension 14 are positioned behind pivot blocks 34 and 36, respectively. User 71 continues to lower leg extension 14 until pivot blocks 34 contacts wall section 60*b* (see FIG. 3D) and pivot block 36 contacts its corresponding wall section. The positioning of lengthwise ends 50 and 52 of leg extension 14 between guides 32 and 33, respectively, prevents lateral movement of leg extension 14 when in the closed position. Apparatus 10 can then be conveniently stored.

In an alternate embodiment, surfaces 16 and 20 of foot base 12 and leg extension 14, respectively, are padded to provide comfort to the legs and feet of the user.

In a further embodiment, the leg extension is not movably attached to the foot base but instead, is removably attached to the foot base. In this configuration, the leg extension does not move when it is attached to foot base. When the leg extension is attached to the foot base, the leg extension is substantially perpendicular to the foot base.

Apparatus 10 of the present invention balances easily in any position and can be used with any style chair or sofa. Apparatus 10 is suitable for use in the home, office, workplace or extended care facility. Apparatus 10 can be manufactured from a variety of material such as wood, plastic, metal, rubber, fiberglass, composite materials, etc. In a preferred embodiment, apparatus 10 is fabricated from solid, fine quality woods such as walnut, mahogany, light-weight pine, hardwood and natural or red oak.

Thus, apparatus 10 of the present invention:

a) allows a person to support, rest or elevate his or her legs and feet without causing muscle strain or stress;

b) balanced easily in any position;

c) can be easily transported;

d) can be easily and conveniently stored when not in use;

e) simple to use;

f) can be used with a variety of chairs and sofas;

g) can be fabricated from a variety of materials; and h) can be manufactured at a reasonable cost.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for supporting and elevating the legs and feet comprising:

a foot base having a pair of lengthwise ends and a feet receiving surface between the lengthwise ends, the foot base further including a pair of cantilever sidewalls, each cantilever sidewall being attached to a corresponding lengthwise end;

a pair of pivot blocks, each pivot block being attached to a corresponding cantilever sidewall, the pivot blocks being generally diametrically positioned with respect to one another and spaced apart from the feet receiving surface; and a leg extension movably attached to the foot base, the leg extension having a leg receiving surface and a pair of lengthwise ends, the leg extension being movable from a closed position to an intermediate position and then from the intermediate position to an opened position, the leg extension having portions thereof positioned behind a corresponding pivot block when the leg extension is in the closed position so as to allow the leg extension to be slid from (i) the closed position to the intermediate position, and (ii) from the intermediate position to the closed position while maintaining the leg receiving surface in a generally confronting relationship with the feet receiving surface of the foot base, the leg extension being pivotal about the pivot blocks when the leg extension is in the intermediate position so as to allow pivotal movement between the intermediate position and the opened position, the leg receiving surface being angulated with respect to the feet receiving surface when the leg extension is in the opened position.

2. The apparatus according to claim 1 wherein the leg extension has a pair of widthwise ends, the leg extension pivoting about one of the widthwise ends between the intermediate position and the opened position.

3. The apparatus according to claim 2 wherein the foot base further includes a pair of recesses in the feet receiving surface, each recess being positioned behind a corresponding pivot block, each recess having a recess wall that has a protrusion extending therefrom.

4. The apparatus according to claim 3 wherein each recess wall has a generally arcuate portion and a substantially straight portion, each straight portion having an axis that is substantially perpendicular to the feet receiving surface.

5. The apparatus according to claim 2 wherein the leg extension further comprises a first portion and a second portion that extend from one of the widthwise ends and which are separated by a relief area, the first and second portions each extending to a distal end, each distal end having a notch therein that is sized for receiving a corresponding protrusion, when the leg extension is in the opened position, the distal ends of the first and second portions contact corresponding recess walls and each protrusion is disposed within a corresponding notch.

6. The apparatus according to claim 5 wherein each distal end is generally rounded to correspond to the curvature of the corresponding arcuate recess wall.

7. The apparatus according to claim 5 wherein each lengthwise end of the leg extension has a recessed portion configured to allow sliding engagement thereon of a corresponding pivot block.

8. The apparatus according to claim 7 wherein each recessed portion is bordered by a wall that (i) defines a slot sized for receiving a corresponding pivot block when the leg extension is pivoted to the opened position and (ii) has a wall portion for contacting the corresponding pivot block when the leg extension is in the closed position.

9. The apparatus according to claim 8 wherein the wall bordering the recessed portion includes a rounded portion, the slot being intermediate the rounded portion and the wall portion that contacts the pivot block, the rounded portion facilitating pivoting action of the leg extension about the pivot blocks when positioning the leg extension into either the opened position or the closed position.

10. The apparatus according to claim 1 wherein the foot base and leg extension surfaces are substantially planar.

11. The apparatus according to claim 10 wherein the leg extension surface is substantially parallel to the feet receiving surface when the leg extension is in the closed position.

12. The apparatus according to claim 10 wherein the leg receiving surface is substantially perpendicular to the foot receiving surface when the leg extension is in the opened position.

13. The apparatus according to claim 1 wherein the foot case includes an opening therein to enable a user to grasp and transport the apparatus.

14. The apparatus according to claim 13 wherein the opening is adjacent the feet receiving surface.

15. The apparatus according to claim 1 wherein the foot base further comprises a pair of longitudinally extending guides, each guide extending upward from the feet receiving surface of the foot base and adjacent to a corresponding lengthwise end of the foot base, when the leg extension is in the closed position, the lengthwise ends of the leg extension are nested between the guides so as to prevent lateral movement of the leg extension.

16. The apparatus according to claim 1 wherein the foot base includes a widthwise end that contacts the floor surface, the foot base end having at least one protrusion attached thereto to create a frictional relationship with the floor.

17. The apparatus according to claim 16 wherein the at least one protrusion comprises a plurality of ribs extending from the widthwise end.

18. The apparatus according to claim 1 wherein the foot base and leg extension are fabricated from plastic.

* * * * *